US005639218A

United States Patent [19]

Tanino et al.

[11] Patent Number: 5,639,218

[45] Date of Patent: Jun. 17, 1997

[54] HIGH PRESSURE WATER PUMP SYSTEM HAVING A RESERVE BOOSTER PUMP

[75] Inventors: Yoshio Tanino; Takuichi Habiro; Takaaki Noda; Kouichi Hayashi, all of Osaka, Japan

[73] Assignee: Daikin Industries, Ltd., Osaka, Japan

[21] Appl. No.: 374,698

[22] PCT Filed: May 25, 1994

[86] PCT No.: PCT/JP94/00834

§ 371 Date: Apr. 5, 1995

§ 102(e) Date: Apr. 5, 1995

[87] PCT Pub. No.: WO94/28303

PCT Pub. Date: Dec. 8, 1994

[30] Foreign Application Priority Data

May 27, 1993 [JP] Japan ..... 5-126132

[51] Int. Cl.[6] ..... F04B 9/10; F04B 23/06

[52] U.S. Cl. ..... 417/3; 417/46; 417/339; 417/344; 417/401; 60/403

[58] Field of Search ..... 417/2, 3, 46, 398, 417/399, 401, 426, 339, 344, 346; 60/402, 421

[56] References Cited

U.S. PATENT DOCUMENTS

| | | | |
|---|---|---|---|
| 3,760,689 | 9/1973 | Johnston | 60/421 |
| 5,527,156 | 6/1996 | Song | 417/2 |

FOREIGN PATENT DOCUMENTS

| | | | |
|---|---|---|---|
| 1453527 | 3/1969 | Germany | 417/3 |
| 50-127204 | 10/1975 | Japan . | |
| 58-57504 | 4/1983 | Japan | 60/421 |
| 59-105977 | 6/1984 | Japan . | |
| 63-39799 | 2/1988 | Japan . | |
| 2-132875 | 11/1990 | Japan . | |
| 3-78575 | 3/1991 | Japan . | |
| 4-105979 | 9/1992 | Japan . | |

*Primary Examiner*—Timothy Thorpe
*Assistant Examiner*—Roland G. McAndrews, Jr.

[57] ABSTRACT

A superhigh pressure generator system is provided which comprises first, second and reserve boosters 1, 2, 3 which are respectively provided with a plunger chambers 4*a*, 4*b*, 4*c* within single rod-type oil hydraulic cylinders 7*a*, 7*b*, 7*c* on the plunger side and are operative to pressurize water sucked into the respective plunger chambers to superhigh pressure, the boosters being connected in parallel each other to a water discharge line 9 via check valves 6*a*, 6*b*, 6*c* respectively. First, second and reserve 3-position directional control valves 13, 14, 15 are interposed between the oil hydraulic cylinders 7*a*, 7*b*, 7*c* of the respective boosters on one hand and first and second oil hydraulic pumps 11, 12 on the other hand so as to permit a reciprocating motion of the oil hydraulic cylinders. On-off valves 20, 21, 23, 22 are respectively provided on discharge lines 17, 18, 19, 16 which connect the three-position directional control valves 13, 14, 15 to the first and second oil hydraulic pumps 11, 12. In this way, the use of a single acting oil cylinder for reserve purposes enables continued operation in the event of seal failure and provides for cost and size reduction.

1 Claim, 4 Drawing Sheets

HIGH PRESSURE WATER PUMP SYSTEM HAVING A RESERVE BOOSTER PUMP

TECHNICAL FIELD

The present invention relates to a superhigh pressure generator system for use in a water-jet type cutting apparatus or the like.

BACKGROUND ART

FIG. 4 shows a circuit diagram for a conventional superhigh pressure generator system employed in a water-jet type cutting apparatus (Japanese Patent Application Laid-open Publication No. 63-39799). The superhigh pressure generator system comprises a booster 61 including a double acting oil hydraulic cylinder 62 having a piston P and plungers $P_1$, $P_2$ arranged at opposite sides thereof and fitted respectively in water-pressurizing plunger chambers $C_3$, $C_4$, and ports at distal ends of the plunger chambers which are connected in parallel to a water supply line 66 from a water supply pump 65 via suction check valves 63, 64, the ports being also connected in parallel via discharge check valves 67, 68 to a superhigh pressure water discharge line 69 provided sequentially with an accumulator 70, a nozzle on-off valve 71, and a jet nozzle 72. A two-position directional control valve 74 for switching the reciprocating motion of the piston is provided between the respective ports at opposite ends of a cylinder chamber of the oil hydraulic cylinder 62 and an oil hydraulic pump 73. Air nozzles 77, 78 are fixed adjacent the jet nozzle 72 and in slightly spaced apart therefrom in the directions of movement (designated by arrows X, Y) of a moving carriage 75 on which is carried a workpiece 76, the air nozzles being connected to a pneumatic power source 81 via on-off valves 79, 80. Relief valves 85, 86 are respectively disposed between the water supply line 66 and a water tank 82 and between a main line 83 for the oil hydraulic pump 73 and an oil tank 84.

When the hydraulic pump 73 is actuated with the two-position directional control valve 74 set to assume a symbol position $V_1$, hydraulic oil is supplied to a cylinder chamber $C_1$ and the hydraulic oil in a cylinder chamber $C_2$ is discharged into the oil tank 84, so that the piston P shifts to the right side and the water in the plunger chamber $C_4$ is pressurized by the plunger $P_2$ to be boosted in proportion to the ratio of sectional area of the piston P to the plunger $P_2$. The water which is boosted by the booster 61 to superhigh pressure (e. g., 3000 kgf/cm$^2$) is ejected from the jet nozzle 72 toward the workpiece 76 after passing through the check valve 68, accumulator 70, and the nozzle on-off valve 71 at symbol position $V_{11}$. Whilst, water from the wager supply pump 65 is sucked via the check valve 63 into the plunger chamber $C_3$, as the pressure therein turns negative as a result of the shifting of the piston P to the right.

Subsequently, when the two-position directional control valve 74 is switched to symbol position $V_2$, the hydraulic oil from the hydraulic pump 73 is supplied to the cylinder chamber $C_2$ and the piston P is shifted to the left, so that the water in the plunger chamber $C_3$ is pressurized by the plunger $P_1$. Thus, the water boosted to superhigh pressure is similarly ejected toward the workpiece 76 via the check valve 67 and other associated members. Whilst, water from the water supply pump 65 is sucked into the plunger chamber $C_4$ which is now under negative pressure.

Since the superhigh pressure generator system will pressurize the water within the plunger chambers $C_3$, $C_4$ to a superhigh pressure of as high as 3000 kgf/cm$^2$, it is likely that seals fitted on the plungers $P_1$, $P_2$ which slide within the plunger chambers will become abrasively damaged during prolonged use. In order to insure continued operation of the generator system in the event of such an occurrence, it is necessary to provide a reserve booster which can be switchably connected to the oil and water hydraulic circuit of FIG. 4.

However, since the superhigh pressure generator system is a booster having superhigh pressure plunger chambers at opposite sides of the double rod-type hydraulic cylinders 62, if the seal on one side becomes abrasively damaged, the booster 61 as a whole can no longer be used as such. For this reason, the generator system also includes one reserve booster of an identical construction. Then, with the prior art reserve booster which comprises a double rod-type cylinder having a pair of plunger chambers for the same work as could be performed by a booster having one plunger chamber, there is caused a problem that such an arrangement results not only in increased cost of manufacture, but also in increased equipment size.

DISCLOSURE OF THE INVENTION

Therefore, it is an object of the present invention to provide a superhigh pressure generator system which includes two booster units, each unit comprising a single rod-type oil hydraulic cylinder having one plunger chamber, and a reserve booster identical in construction with each of the booster units, the reserve booster being connected in parallel with the booster units, and which can thereby achieve manufacturing cost reduction as well as size reduction.

In order to accomplish the above object, according to the invention, a superhigh pressure generator system is provided which comprises a first booster, a second booster, and a reserve booster which respectively define a plunger chamber on the side of a plunger connected to a piston of a single rod-type oil hydraulic cylinder, each of the boosters being operative to discharge water that is sucked into the respective plunger chamber and pressurized by the plunger, a first directional control means, a second directional control means, and a reserve directional control means which are respectively interposed between corresponding oil hydraulic cylinders of the first, second and reserve boosters and a oil hydraulic power source for actuating respective hydraulic cylinders to go into reciprocating motion, and on-off valves provided on respective discharge lines connecting each directional control means to the oil hydraulic power source.

According to the above described arrangement, the on-off valve provided on the discharge line connecting the oil hydraulic power source to the reserve directional control means is closed, and the on-off valves provided on the respective discharge lines connecting the oil hydraulic power source to the first and second directional control means are opened, whereby hydraulic oil from the oil hydraulic power source is supplied to and discharged from the oil hydraulic cylinders of the first and second boosters via the first and second directional control means. Then, alternate pressing action of the pair of oil hydraulic cylinders causes pressurized water of superhigh pressure to be discharged alternately from the water pressurizing plunger chambers toward a water discharge line, and such water is ejected from a jet nozzle or the like at the discharge end of the water discharge line, for example, after being pulse-attenuated by an accumulator.

Assume that the seal at the oil hydraulic cylinder of, for example, the second booster becomes abrasively damaged, then an operator will close the on-off valve located upstream of the second directional control means, and will in turn open the on-off valve located upstream of the reserve directional control means. As a result, hydraulic oil is supplied from the oil hydraulic power source to the oil hydraulic cylinder of the reserve booster and vice versa via the first and reserve directional control means, whereupon pressurized water of superhigh pressure is discharged to superhigh pressure water discharge line by alternate pressing movement of the two oil hydraulic cylinders.

In this way, only through the provision of one reserve booster having a single rod-type oil hydraulic cylinder, instead of one reserve booster having a double rod-type oil hydraulic cylinder, in the event that the seal should become abrasively damaged at one of the first and second boosters, operation can be readily continued. This arrangement also provides for cost and size reduction.

BEST MODE FOR CARRYING OUT THE INVENTION

The invention will now be described in further detail with respect to one illustrated embodiment.

Figure 1:
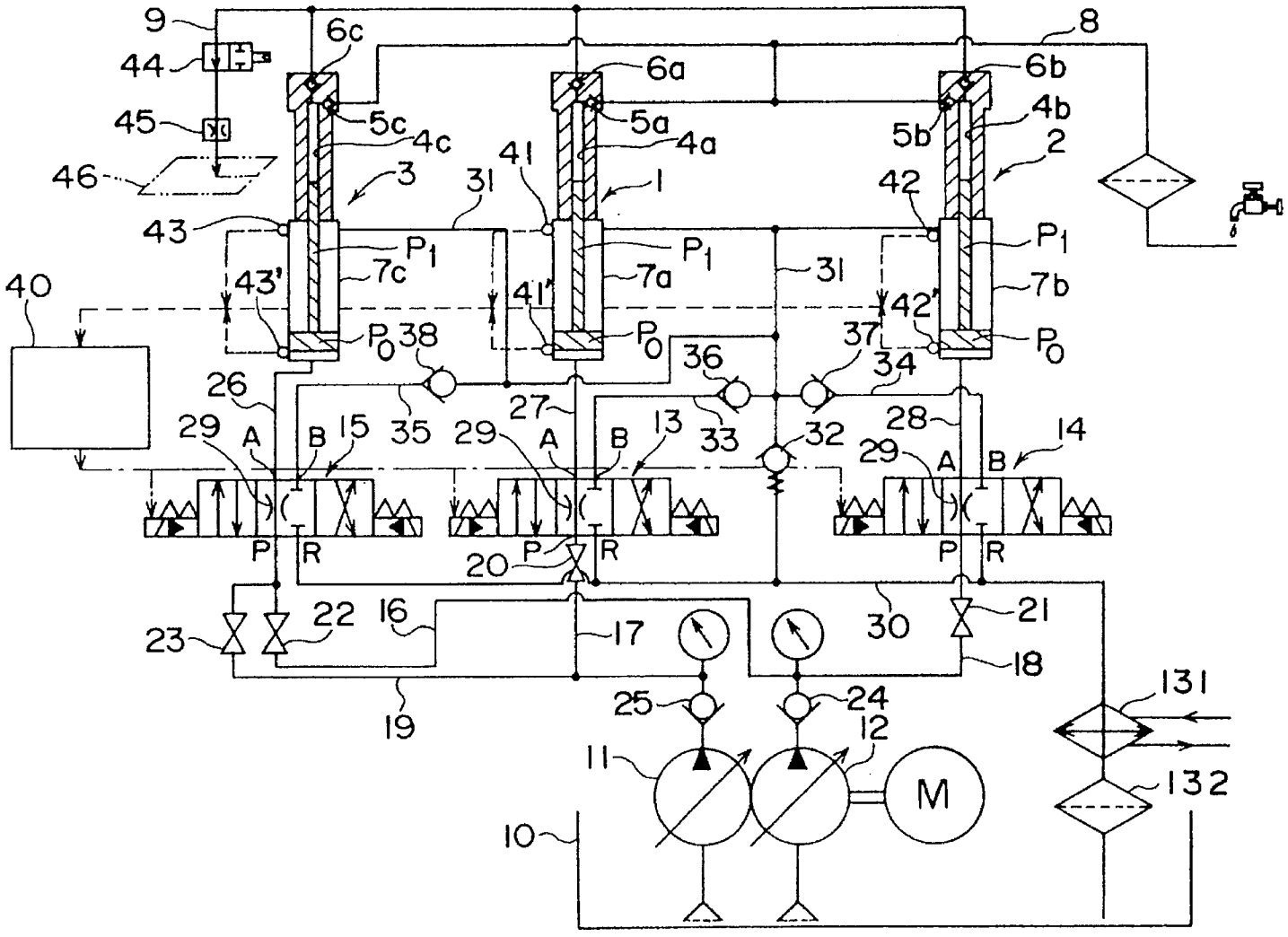
FIG. 1 is a circuit diagram showing one embodiment of a water-jet type cutting apparatus incorporating a superhigh pressure generator system in accordance with the present invention.

FIG. 1 is a circuit diagram showing a water-jet type cutting apparatus incorporating a superhigh pressure generator system of the invention. The superhigh pressure generator system includes a first booster 1, a second booster 2, and a reserve booster 3 which are connected in parallel to a superhigh pressure-water discharge line 9 via discharge check valves 6*a*, 6*b*, 6*c*. The boosters 1, 2, 3 are operative, through reciprocal movement of oil hydraulic cylinders 7*a*, 7*b*, 7*c* respectively, to pressurize water that is sucked from a water supply line 8 into water-pressurizing plunger chambers 4*a*, 4*b*, 4*c* via suction check valves 5*a*, 5*b*, 5*c*, to superhigh pressure by plungers $P_1$ connected to pistons $P_0$, and discharge the pressurized water to the water discharge line 9.

Disposed between the first booster 1 and a first oil hydraulic pump 11 of the variable capacity type is a three-position directional control valve 13 having changeover positions, i. e., pressurizing, prepressurizing, and suction, port P of which is connected to a discharge line 17 for the first oil hydraulic pump 11 on which are provided an on-off valve 20 and a check valve 25. Port A of the directional control valve is connected to a line 27 communicating with a head-side port of an oil hydraulic cylinder 7*a* of the first booster 1. Likewise, a similar three-position directional control valve 14 is disposed between the second booster 2 and a second oil hydraulic pump 12 of the variable capacity type, port P of the directional control valve being connected to a discharge line 18 of the second oil hydraulic pump 12 on which are provided an on-off valve 21 and a check valve 24, with port A connected to a line 28 communicating with a head-side port of an oil hydraulic cylinder 7*b* of the second booster 2. Further, there is disposed a similar three-position directional control valve 15 for the reserve booster 3, port P of which is connected to the discharge lines 17 and 18 through respectively a line 19 fitted with an on-off valve 23 and a line 16 fitted with an on-off valve 22, while port A of the directional control valve is connected to a line 26 communicating with a head-side port of an oil hydraulic cylinder 7*c* of the reserve booster 3.

Thus, the above described directional control valves 13, 14, 15 constitute first, second and reserve directional control means for reciprocating corresponding oil hydraulic cylinders 7 of the boosters 1, 2, 3, while the first and second oil hydraulic pumps 11, 12 and the oil tank 10 constitute the oil hydraulic power sources.

Ports P, R, A, B of each three-position directional control valve 13, 14, 15 are of such arrangement that P and R are respectively connected with A and B at the left side position, i. e., pressurizing position, in the illustrated circuit, and with B and A at the right side position, i. e., suction position, while at the center valve position, i.e., prepressurizing position, P and A are interconnected through a passage having a throttle 29 and R and B are shut off from each other. Port R of each three-position directional control valve 13, 14, 15 is connected to a common return line 30 which is provided with a cooler 131 and a filter 132. Plunger chamber side ports of the three oil hydraulic cylinders 7*a*, 7*b*, 7*c* are each connected to the common return line 30 by a common line 31 which is fitted with a check valve 32 for back pressure setting so as to permit flow toward the return line 30. Further, a portion of the common line 31 which is located past the check valve 32 and nearer to each oil hydraulic cylinder is connected to port B of each three-position directional control valve 13, 14, 15 through a line 33, 34. 35 which is fitted with a check valve 36, 37, 38 for checking any oil flow against the three-position directional control valve.

The first oil hydraulic cylinder 7*a* is provided with a first forward stroke sensor 41 which includes a proximity switch for detecting that the piston in the course of its forward stroke or pressing stroke has reached a point close to the end of the pressing stroke, and a first return stroke sensor 41' which includes a proximity switch for detecting that the piston in the course of its return stroke or suction stroke has reached a point close to the end of the suction stroke. Similarly, the second oil hydraulic cylinder 7*b* and the reserve oil hydraulic cylinder 7*c* are respectively provided with a second forward stroke sensor 42 and a second return stroke sensor 42', and a reserve forward stroke sensor 43 and a reserve return stroke sensor 43'. The relationship between these sensors with respect-to their mounting positions may be explained as follows by FIG. 3 wherein time changes in pressing strokes (forward strokes) 7*a*, 7*b* are taken on the axis of ordinate.

Figure 3:
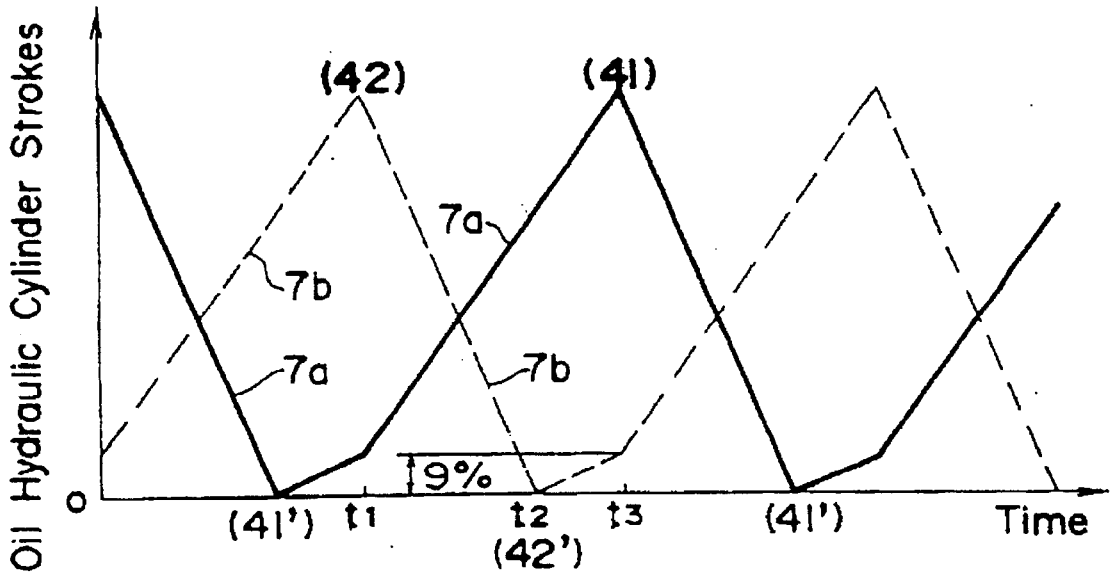
FIG. 3 is a diagram showing time changes in the strokes of oil hydraulic cylinders of first and second boosters in FIGS. 2A. 2B 2C.

When the first oil hydraulic cylinder 7*a* as represented by a solid line in FIG. 3 which descends to the right reaches the first return stroke sensor 41', the first three-position directional control valve 13 is switched from the right-side position to center valve position for supplying hydraulic oil to the first oil hydraulic cylinder 7*a*; then, a pressing stroke of the first oil hydraulic cylinder 7*a* progresses as much as 9% of one full stroke as shown by a solid line in FIG. 3 which ascends to the right before the second oil hydraulic cylinder 7*b* as represented by a broken line which ascends to the right reaches the second forward stroke sensor 42 at the end of pressing stroke, so that the water pressure in the plunger chamber 4*a* of the first booster 1 has already reached a predetermined superhigh discharge pressure level.

Conversely, assume that the second oil hydraulic cylinder 7b or the reserve oil hydraulic cylinder 7c reach the second return stroke sensor 42' or the reserve return stroke sensor 43' respectively, their strokes being switched first to prepressing next to pressing strokes. In this case, too, it may be apparent from FIG. 3 that the same will apply for the time period of up to their reaching the second forward stroke sensor 42 or reserve forward stroke sensor 43 respectively.

Further, as FIG. 1 shows, the superhigh pressure generator system of the invention includes a control unit 40 for switchingly controlling the three-position directional control valves 13, 14, 15 in response to detection signals received from the sensors 41, 41', 42, 42', 43, 43'. The control unit 40 is operative in such a way that when, for example, the on-off valves 20, 21 on the discharge lines 17, 18 are opened so that the first and second boosters 1, 2 are in operative condition, and when the first three-position directional control valve 13 is at the left side position as shown so that the first booster 1 is at its pressurizing stage, the control unit, upon receipt of a detection signal from the second return stroke sensor 42', causes the second three-position directional control valve 14 to be switched from the right side position to the center valve position, and then, upon receipt of a detection signal from the first forward stroke sensor 41, causes the first three-position directional control valve 13 to be switched from the left side position to the right side position, and the second three-position directional control valve 14 to be switched from the center valve position to the left side position. Also, when the second three-position directional control valve 14 is at the left side position as shown so that the second booster 2 is at its pressurizing stage, the control unit, upon receipt of a detection signal from the first return stroke sensor 41', causes the first three-position directional control valve 13 to be switched from the right side position to the center valve position, and then, upon receipt of a detection signal from the second forward stroke sensor 42, causes the second three-position directional control valve 14 to be switched from the left side position to the right side position, and the first three-position directional control valve 13 to be switched from the center valve position to the left side position.

Further, when the on-off valves 20, 22 are opened so that the first and reserve boosters 1, 3 are in operative condition, the control unit 40 switchingly controls the first and reserve three-position directional control valves 13, 15 in the same way as described above, and likewise, when the on-off valves 21, 23 are opened so that the second and reserve boosters 2, 3 are in operative condition, the control unit switchingly controls the second and reserve three-position directional control valves 14, 15.

By way of example, the first and second three-position directional control valves 13, 14 are controlled by the control unit 40 as follows. At time $t_1$ in FIG. 3, the first three-position directional control valve 13 which has been at center valve position in FIG. 1 is caused to be switched over to the left side position in response to a detection signal from the second forward stroke sensor 42, and where the discharge pressure is at, for example, 3000 kgf/cm$^2$, the first booster 1 which has travelled up to 9% of one full pressing stroke at low speed goes into a high-speed pressing stroke (see the solid line in FIG. 3), while the second three-position directional control valve which has been at the left side position in FIG. 1 is caused to be switched over to the right side position in response to a detection signal from the second forward stroke sensor 42 so that the second booster 2 goes into a suction stroke (see the broken line in FIG. 3) from the pressing stroke (from the FIG. 2A state to the FIG. 2B state). Next, at time $t_2$ in FIG. 3, when the second return stroke sensor 42' detects the approach of the piston, the second three-position directional control valve 14 switched to center valve position in FIG. 1, whereupon the second booster 2 which has reached the end of suction stroke goes into a low-speed pressing stroke (prepressing stroke) under oil supply via the throttle 29 (from the FIG. 2B state to the FIG. 2C state).

Figure 2A:
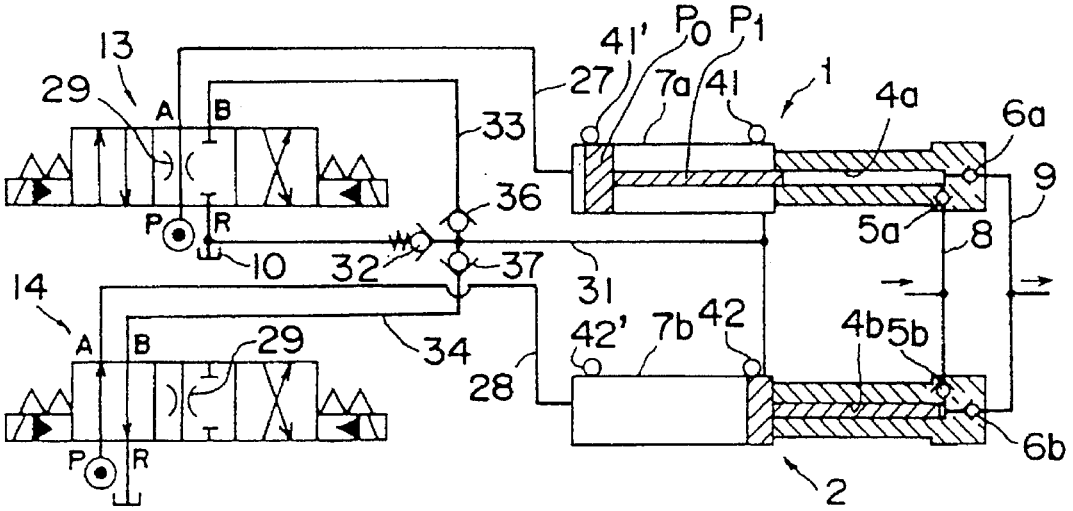
FIGS. 2A, 2B, 2C are diagrams showing an operating sequence with respect to the superhigh pressure generator system.
Figure 2B:
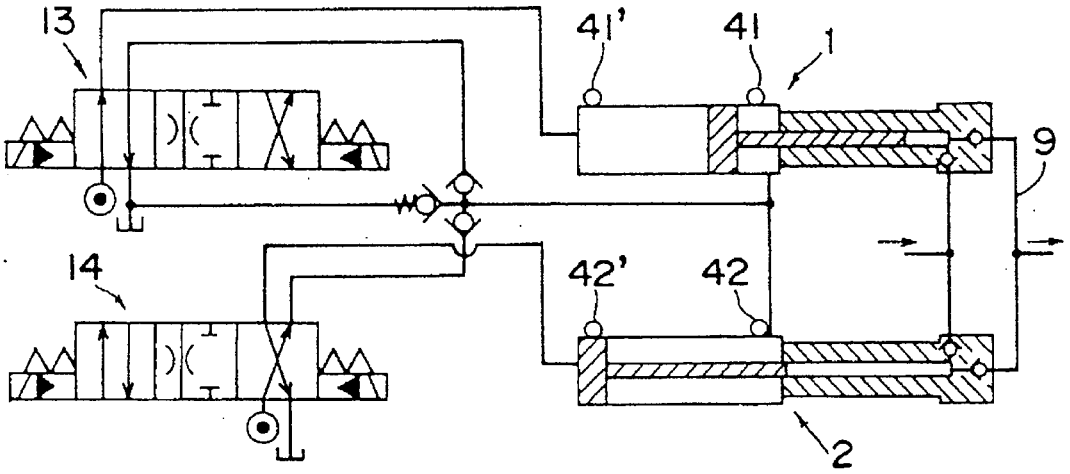
Figure 2C:
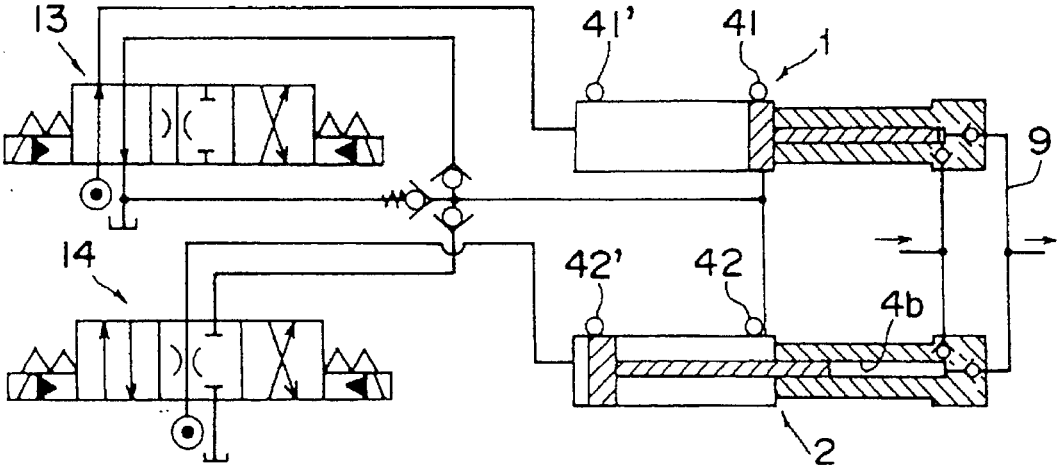

Then, at time $t_3$ in FIG. 3, when the first booster 1 reaches the end of pressing stroke so that the first three-position directional control valve 13 is switched to the FIG. 1 right side position in response to a detection signal from the first forward stroke sensor 41, the second booster 2 which has travelled up to 9% of one full pressing stroke goes into a high-speed pressing stroke as a result of the second three-position directional control valve 14 being switched over to the left side position in response to a detection signal from the first forward stroke sensor 41 (from the FIG. 2C state to the state a little before FIG. 2A). It may be noted in the above conjunction that the first, second and reserve boosters 1, 2, 3 are of such arrangement that when they have travelled up to 9% of one full pressing stroke at low speed through respective throttles 29 of the three-position directional control valves 13, 14, 15, the water pressure within each of the plunger chambers 4a, 4b, 4c reaches the predetermined discharge pressure of superhigh pressure level (e.g., 3000 kgf/cm$^2$).

Needless to say, the foregoing description will apply to the directional control control of the first and reserve three-position directional control valves 13, 15 by the control unit 40, as well as to the changeover control of the second and reserve three-position directional control valves 14, 15.

The water-jet type cutting apparatus employing the above described superhigh pressure generator system comprises, as shown in FIG. 1, a water discharge line 9 connected through discharge check valves 6a, 6b, 6c to respectively the first, second and reserve boosters 1, 2, 3, and an on-off valve 44 and a jet nozzle 45 which are disposed on the water discharge line sequentially toward a distal end thereof, such that the jet nozzle 45 ejects superhigh pressure water by which a workpiece 46 is cut.

The manner of operation of the superhigh pressure generator system will now be described with reference to FIGS. 2A, 2B, 2C, which is substantially applicable for description of the operation of the water-jet type cutting apparatus.

Assume that the on-off valves 20, 21 on discharge lines 17, 18 are opened and the on-off valves 22, 23 on lines 16, 19 are closed, so that the first and second boosters 1, 2 are in operation, while the reserve booster 3 is in rest state. Then, before the piston of the second booster 2 reaches the end of pressing stroke in FIG. 1A, the piston of the first booster 1 passes the first return stroke sensor 41', at which point of time the control unit 40 causes the first three-position directional control valve 13 to be switched from the right side position to the center valve position in response to a passage detection signal from the sensor, whereby the first booster 1 shifts from a suction stroke into a low-speed pressing stroke (prepressing stroke) under the action of the throttle 29 and, when the second booster 2 reaches the end of pressing stroke as shown in FIG. 2A, if the discharge pressure is, for example, 3000 kgf/cm$^2$, the first booster 1 travels 9% of one full pressing stroke, so that it is ready to discharge a pressurized water of that discharge pressure from the plunger chamber 4a. Thus, at the end of superhigh pressure water discharge from the second booster 2, the first booster 1 begins to discharge superhigh pressure water, so that any water pressure variation in the water discharge line 9 is reduced even where no accumulator 70 (see FIG. 4) is provided, a superhigh pressure water involving less pulsation being thus ejected toward the workpiece 46 from the jet nozzle 45 (see FIG. 1) at the forward end of the line. Upon receipt of a detection signal from the second forward stroke sensor 42, the control unit 40 causes the second three-position directional control valve 14 to be switched from the left side position to the right side position, and the first three-position directional control valve 13 from the center valve position to the left side position. Thus, the second booster 2 is switched over to a suction stroke, and the first booster 1 is switched over to a high speed pressing stroke.

Then, as FIG. 2B shows, when the second booster 2 reaches the second return stroke sensor 42' adjacent the end of suction stroke while the first booster 1 is in the course of its pressing stroke, the control unit 40 causes the second three-position directional control valve 14 to be switched from the right side position to the center valve position in response to a passage detection signal from the sensor 42', and the second booster 2 starts a low speed pressing stroke (prepressing stroke) under the action of the corresponding throttle 29.

When the first booster 1 reaches the end of pressing stroke as shown in FIG. 2C, the second booster 2 has travelled 9% of one full pressing stroke in the case of a discharge pressure of, for example, 3000 kgf/cm$^2$ and is ready to discharge a pressurized water of that discharge pressure from the plunger chamber **4*b*. That is, at the end of pressurized water discharge of superhigh pressure from the first booster 1, the second booster 2 begins to discharge superhigh pressure water. Therefore, any water pressure variation in the water discharge line 9 is likewise reduced so that a superhigh pressure water involving less pulsation is ejected from the jet nozzle 45**.

In this way, without provision of a costly superhigh-pressure accumulator 70 (see FIG. 4) in the water discharge line 9, the invention provides for reduction in water pressure variations in superhigh pressure water, thus enabling pulsation-free superhigh pressure water to be ejected from the jet nozzle 45 toward the workpiece 46. Therefore, the invention also provides for improvement in the performance and service life of units of equipment, such as boosters 1, 2, as employed in oil and water hydraulic circuits, as well as for cost and size reduction in the manufacture of superhigh pressure generating systems, and even water-jet type cutting apparatuses.

Now, let's assume that, as a result of long-time use, for example, the seal at the second oil hydraulic cylinder **7*b* of the second booster 2 was worn out or damaged. Then, the user will close the on-off valve 21 upstream of the second three-position directional control valve 14, and will in turn open the on-off valve 22 upstream of the reserve three-position directional control valve 15, thereby to put the second booster in rest state and put the reserve booster 3 in operation. Then, the control unit 40 will switchingly control the first booster 1 and the reserve booster 3 in the same manner as described above (FIGS. 2A, 2B, 2C). Thus, hydraulic oil is supplied from the first oil hydraulic pump 11 through the first three-position directional control valve 13, and from the second oil hydraulic pump 12 through the reserve three-position directional control valve 15, to the oil hydraulic cylinders 7*a*, 7*c* of the first and reserve boosters 1, 3 respectively, so that water pressurized to a superhigh pressure level with little pulsation is discharged toward the water discharge line 9** by alternate pressing action of the two oil hydraulic cylinders, it being thus possible to obtain the same performance effect as earlier described.

Figure 4:
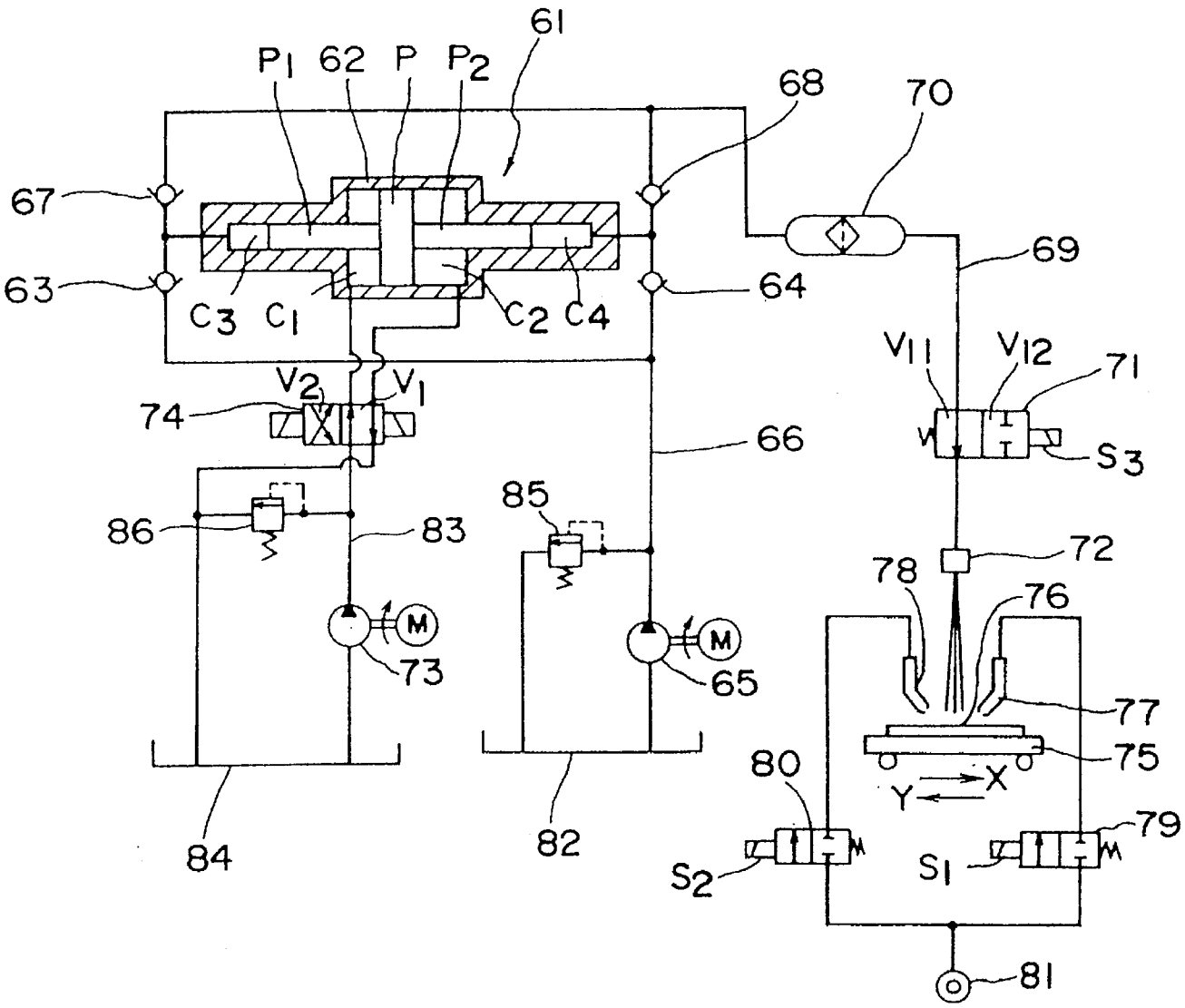
Fig. 4 PRIOR ART
FIG. 4 is a circuit diagram showing a prior art superhigh pressure generator system.

In this way, with mere addition of one superhigh-pressure reserve booster having a single rod-type oil hydraulic cylinder and not addition of one such superhigh-pressure reserve booster having a double rod-type oil hydraulic cylinder as illustrated in FIG. 4, it is possible to cope with such situation that the seal at one of the first and second boosters 1, 2 has become worn out or damaged. This, coupled with the fact that the provision of an accumulator at the water discharge line is not particularly required as already mentioned, permits continued operation in the event of the above mentioned situation, and provides for further cost reduction as well as size reduction.

In the above described embodiment, a throttle 29 is provided in a passageway connecting between ports P and A at the center valve position of each of the three-position directional control valves 13, 14, 15, i. e., a switching position for prepressing strokes. This provides an advantage that flow rates of hydraulic oil as supplied from the oil hydraulic pumps 11, 12 to respective boosters 1, 2, 3 can be regulated so that the pressure of the pressurized water in each respective plunger chamber **4*a*, 4*b*, 4*c*** may be maintained at the predetermined discharge pressure.

Further, the plunger chamber-side ports of oil hydraulic cylinders **7*a*, 7*b*, 7*c* of the boosters 1, 2, 3 are connected to the oil tank 10 via the common return line 31 which is fitted with a check valve 32 for back pressure setting, the line, at points which are nearer to respective oil hydraulic cylinders as viewed from the check valve 32 is connected to ports B of respective three-position directional control valves via lines 33, 34, 35 on which are provided check valves 36, 37, 38 so as to hinder oil flow. Therefore, the hydraulic oil discharged from the booster which is in the course of pressing stroke is restrained from flowing toward the tank 10 without regard to respective switching positions of the three-position directional control valves 13, 14, 15**, with the result that the hydraulic oil flows into the booster which is in the course of suction stroke, thereby to accelerate suction stroke or piston return stroke. This provides an advantage of cycle time reduction.

In the foregoing embodiment, the oil hydraulic source consists of the first oil hydraulic pump 11 for one booster, and the second oil hydraulic pump 12 for the other booster. As compared with the case where oil supply is made by a single and common oil hydraulic pump, therefore, the embodiment provides another advantage that load fluctuations at the oil hydraulic pump side can be reduced, which means that water pressure fluctuations with respect to the superhigh pressure water discharged toward the water discharge line 9 can be further reduced.

Needless to say, the water-jet type cutting apparatus employing the superhigh pressure generator system of the above described embodiment has the above mentioned advantages of the superhigh pressure generator system, in addition to the earlier described advantages of the apparatus itself.

In the above described embodiment, the oil hydraulic power source consists of the first and second oil hydraulic pumps of the variable capacity type exclusive for respective boosters. Alternatively, the oil hydraulic power source may consists of a single oil hydraulic pump of the variable capacity type or a single fixed capacity type oil pump.

It is possible that the sensors provided in the oil hydraulic cylinders of respective boosters and the control unit may be omitted and, and in place thereof an accumulator may be provided on the water discharge line. Even in this case, merely by adding one single-acting oil hydraulic cylinder it is possible to cope with such situation that one of the first and second boosters has become worn out or damaged and, therefore, to achieve cost and size reduction with respect to the superhigh pressure generator system and even with respect to the water-jet type cutting apparatus.

As is apparent from the above description, the superhigh pressure generator system of the present invention comprises first, second and reserve boosters each having a plunger chamber defined in a plunger side portion of a single rod-type oil hydraulic cylinder, the boosters being operative to pressurize and discharge water sucked into the respective plunger chambers, first, second and reserve directional control means interposed between the respective boosters and the oil hydraulic power source for actuating the oil hydraulic cylinders of respective boosters to perform a reciprocating motion, and on-off valves provided on discharge lines connecting between the respective directional control means and the oil hydraulic power source. Therefore, merely by adding one superhigh pressure reserve booster having a single rod-type oil hydraulic cylinder and not one superhigh-pressure reserve booster having a double rod-type oil hydraulic cylinder, it is possible to cope with such situation that one of the first and second boosters has become worn out or damaged. This permits continued operation and provides for cost and size reduction.

Industrial Applicability

The superhigh pressure generator system of the invention is applicable to water-jet type cutting apparatuses and the like.

We claim:

1. A superhigh pressure generator system comprising a first booster, a second booster, and a reserve booster which are respectively provided with a plunger chamber, a piston on one side of a plunger and an oil hydraulic cylinder, each of the boosters being operative to discharge water in a discharge line that is sucked into each respective plunger chamber from a water supply line and pressurized by each plunger;

a first directional control means for actuating the piston of the oil hydraulic cylinder of the first booster in reciprocal motion, and a first on-off valve, said first directional control means and said first on-off valve being interposed between the oil hydraulic cylinder of the first booster and a first oil hydraulic power source;

a second directional control means for actuating the piston of the oil hydraulic cylinder of the second booster in reciprocal motion, and a second on-off valve, said second directional control means and said second on-off valve being interposed between the oil hydraulic cylinder of the second booster and a second oil hydraulic power source;

a reserve directional control means for actuating the piston of the oil hydraulic cylinder of the reserve booster in reciprocal motion;

reserve on-off valves provided on discharge lines connecting the reserve directional control means to the first and second oil hydraulic power sources respectively, whereby two boosters are in operation at one time;

sensors provided on each of the oil hydraulic cylinders in order to detect the piston reaching in the vicinity of top and bottom dead centers; and a control means for switchingly controlling the first, second and reserve directional control means in response to detection signals received from the sensors.

* * * * *